US010971063B2

(12) United States Patent
Liu et al.

(10) Patent No.: US 10,971,063 B2
(45) Date of Patent: Apr. 6, 2021

(54) PIXEL CIRCUIT AND DISPLAY DEVICE

(71) Applicant: SeeYA Optronics Co., Ltd., Shanghai (CN)

(72) Inventors: Ping-Lin Liu, Shanghai (CN); Haodong Zhang, Shanghai (CN)

(73) Assignee: SeeYA Optronics Co., Ltd., Shanghai (CN)

( * ) Notice: Subject to any disclaimer, the term of this patent is extended or adjusted under 35 U.S.C. 154(b) by 0 days.

(21) Appl. No.: 16/413,973

(22) Filed: May 16, 2019

(65) Prior Publication Data

US 2020/0043409 A1 Feb. 6, 2020

(30) Foreign Application Priority Data

Aug. 6, 2018 (CN) ..... 201821259306.9

(51) Int. Cl.
*G09G 3/3233* (2016.01)

(52) U.S. Cl.
CPC ... *G09G 3/3233* (2013.01); *G09G 2300/0439* (2013.01); *G09G 2300/0809* (2013.01); *G09G 2330/028* (2013.01)

(58) Field of Classification Search
None
See application file for complete search history.

(56) References Cited

U.S. PATENT DOCUMENTS 6,501,449 B1 * 12/2002 Huang ..... G09G 3/3216 345/212
2004/0130545 A1 * 7/2004 Ishizuka ..... G09G 3/3233 345/212
2005/0062686 A1 * 3/2005 Iguchi ..... G09G 3/3233 345/46
2005/0231448 A1 * 10/2005 Tanabe ..... G09G 3/3233 345/76
2007/0075939 A1 * 4/2007 Cho ..... G09G 3/3233 345/76
2007/0262931 A1 * 11/2007 Peng ..... G09G 3/3233 345/76
2013/0099692 A1 * 4/2013 Chaji ..... G09G 3/3283 315/224
2013/0278587 A1 * 10/2013 Kawano ..... G09G 3/3233 345/212
2015/0042692 A1 * 2/2015 Kim ..... G09G 3/3233 345/690

* cited by examiner

*Primary Examiner* — Dorothy Harris
(74) *Attorney, Agent, or Firm* — Occhiuti & Rohlicek LLP

(57) ABSTRACT

A pixel circuit and a display device are provided. The pixel circuit includes a pixel unit which includes an operating current generating module and a light emission control module. The operating current generating module has a gate voltage terminal and is configured to generate an operating current according to a voltage of the gate voltage terminal. The light emission control module is connected in series with the operating current generating module and configured to control whether to provide the operating current to a light emitting device according to a light emission control signal. The driving control circuit includes: a data current module, configured to provide a data current and to input the data current to the gate voltage terminal; and a current adjusting module, configured to control whether to input a compensation current to the gate voltage terminal according to a current value of the operating current.

17 Claims, 3 Drawing Sheets

PIXEL CIRCUIT AND DISPLAY DEVICE

CROSS-REFERENCE TO RELATED APPLICATIONS

This application claims the benefit of priority to Chinese Patent Application No. 201821259306.9, titled "PIXEL CIRCUIT AND DISPLAY DEVICE", filed on Aug. 6, 2018, the entire disclosure of which are incorporated herein by reference.

TECHNICAL FIELD

The present disclosure relates to display panel technology field, and more particularly, to a pixel circuit and a display device.

BACKGROUND

Organic Light Emitting diode (OLED), as an all-solid-state device configured to convert electrical energy directly into light energy, has attracted great attention in the industry and is considered as a new generation of display devices, due to its advantages of thinness, lightness, high contrast, fast response, wide viewing angle, wide operating temperature range and so on. It is necessary to improve luminous efficiency and stability of OLED devices and to design effective pixel circuits, so as to realize large-scale industrialization.

The existing pixel circuits include voltage-type pixel circuits and current-type pixel circuits. The current-type pixel circuits can effectively compensate threshold voltage drift and channel mobility of driving transistors. However, there is a problem in the current-type pixel circuits that a settling time of gate voltage of a driving transistor is too long, resulting in that the gate voltage of the driving transistor cannot quickly follow data current signal in a microsecond scanning time of one row of pixels, which may further affect establishment of operating current of light-emitting devices in the pixel circuit.

SUMMARY

In order to quickly establish a voltage for generating an operating current of a light emitting device in a current-type pixel circuit, a pixel circuit and a display device are provided according to embodiments of the present disclosure.

In some embodiments, the pixel circuit may include: a pixel unit, including an operating current generating module and a light emission control module, where the operating current generating module has a gate voltage terminal and is configured to generate an operating current according to a voltage of the gate voltage terminal, and the light emission control module is connected in series with the operating current generating module, and is configured to control whether to provide the operating current to a light emitting device according to a light emission control signal; and a driving control circuit, including a data current module and a current adjusting module, where the data current module is configured to provide a data current and to input the data current to the gate voltage terminal, and the current adjusting module is configured to control whether to input a compensation current to the gate voltage terminal according to a current value of the operating current.

In some embodiments, the operating current generating module may include: a driving module, a second gating module and a voltage holding module; a control terminal of the driving module is connected with the gate voltage terminal via a first gating module, the driving module is configured to generate the operating current according to a voltage of the control terminal, and the first gating module is turned on or turned off under control of a first gating control signal; an output terminal of the driving module is connected with the gate voltage terminal via the second gating module, and the second gating module is turned on or turned off under control of the second gating control signal; the voltage holding module is configured to maintain a voltage of the control terminal of the driving module when the first gating module is turned off.

In some embodiments, the driving module may include a first transistor, a source of the first transistor is connected with a power supply, a gate of the first transistor serves as the control terminal of the driving module, and a drain of the first transistor serves as the output terminal of the driving module.

In some embodiments, the first gating module may include a second transistor, a gate of the second transistor is configured to be input with the first gating control signal, a source of the second transistor is connected with the control terminal of the driving module, and a drain of the second transistor is connected with the gate voltage terminal.

In some embodiments, the second gating module may include a third transistor, a gate of the third transistor is configured to be input with the second gating control signal, a drain of the third transistor is connected with the gate voltage terminal, and a source of the third transistor is connected with the output terminal of the driving module.

In some embodiments, the voltage holding module may include a capacitor, a first electrode plate of the capacitor is connected with the control terminal of the driving module, and a second electrode plate of the capacitor is connected with a reference voltage terminal.

In some embodiments, the light emission control module may include a fourth transistor, a gate of the fourth transistor is configured to be input with the light emission control signal, a drain of the fourth transistor is connected with the output terminal of the operating current generating module, and a source of the fourth transistor is connected with the light emitting device.

In some embodiments, the data current module may be connected with a data voltage terminal; and the data current module is configured to generate the data current according to a data voltage of the data voltage terminal, or the data current module is configured to receive the data current from an external and to input the data current to the gate voltage terminal.

In some embodiments, the data current module may include: an operational amplifier, a first input terminal of the operational amplifier being connected with the data voltage terminal; a fifth transistor, a drain of the fifth transistor being connected with a second input terminal of the operational amplifier, a gate of the fifth transistor being connected with an output terminal of the operational amplifier, a source of the fifth transistor being connected with a power supply, and the drain of the fifth transistor being configured to output the data current; and a first resistor, a first terminal of the first resistor being connected with the drain of the fifth transistor, and a second terminal of the first resistor being grounded.

In some embodiments, the data current module may further include a current duplicating module, where the current duplicating module is configured to mirror the data current and is coupled with the gate voltage terminal.

In some embodiments, the current duplicating module may include: a sixth transistor, a gate of the sixth transistor being connected with the output terminal of the operational amplifier, and a source of the sixth transistor being connected with a power supply; a seventh transistor, a drain of the seventh transistor being connected with a drain of the sixth transistor, the drain of the seventh transistor being connected with a gate of the seventh transistor, and a source of the seventh transistor being grounded; an eighth transistor, a gate of the eighth transistor being connected with the gate of the seventh transistor, a source of the eighth transistor being grounded, and a drain of the eighth transistor being connected with the gate voltage terminal.

In some embodiments, the current adjusting module may include: a first current mirroring module, configured to mirror the operating current of the operating current generating module to obtain a mirror current; a compensation current generating module, configured to generate the compensation current; and a comparing module, configured to compare the data current and the mirror current, and to determine whether to input the compensation current to the gate voltage terminal according to a comparison result.

In some embodiments, the first current mirroring module may include: a ninth transistor, a gate of the ninth transistor being connected with the gate voltage terminal, and a source of the ninth transistor being connected with a power supply; and a second resistor, a first terminal of the second resistor being connected with a drain of the ninth transistor, and a second terminal of the second resistor being grounded In some embodiments, the compensation current generating module may include a second current mirroring module configured to mirror the data current to obtain the compensation current.

In some embodiments, the comparing module may include: a comparator, a first input terminal of the comparator being configured to be input with a first voltage, a second input terminal of the comparator being configured to be input with a second voltage, and an output terminal of the comparator being configured to output a switch control signal, where the first voltage is obtained by a conversion of the mirror current, and the second voltage is obtained by a conversion of the data current; and a gating switch, an input terminal of the gating switch being configured to be input with the compensation current, an output terminal of the gating switch being connected with the gate voltage terminal, and a control terminal of the gating switch being configured to be input with the switch control signal.

In some embodiments, the pixel circuit may further include a tenth transistor, a gate of the tenth transistor is configured to be input with a reset control signal, a source of the tenth transistor is configured to be input with a reset voltage, and a drain of the tenth transistor is coupled with an anode of the light emitting device.

In some embodiments, a current direction of the compensation current is the same as or opposite to a current direction of the data current.

A display device including the aforementioned pixel circuit is also provided according to embodiments of the present disclosure.

Compared with the conventional technology, the present disclosure has the following advantages.

The pixel circuit includes a pixel unit and a driving control circuit. The pixel unit includes an operating current generating module and a light emission control module, where the operating current generating module has a gate voltage terminal and is configured to generate an operating current according to a voltage of the gate voltage terminal, and the light emission control module is connected in series with the operating current generating module and is configured to control whether to provide the operating current to a light emitting device according to a light emission control signal. The driving control circuit includes a data current module and a current adjusting module, where the data current module is configured to provide a data current and to input the data current to the gate voltage terminal, and the current adjusting module is configured to control whether to input a compensation current to the gate voltage terminal according to a current value of the operating current. Therefore, when the operating current has a small current value, the voltage of the gate voltage terminal can be quickly established via an interaction between the data current and the compensation current.

Further, the comparing module in the pixel circuit of the present disclosure may include a comparator and a gating switch. A first input terminal of the comparator is configured to be input with a first voltage, a second input terminal of the comparator is configured to be input with a second voltage, and an output terminal of the comparator is configured to output a switch control signal, where the first voltage is obtained by a conversion of the mirror current, and the second voltage is obtained by a conversion of the data current. An input terminal of the gating switch is configured to be input with the compensation current, an output terminal of the gating switch is connected with the gate voltage terminal, and a control terminal of the gating switch is configured to be input with the switch control signal. Thus, a circuit structure of the comparing module can be simplified and the device cost can be effectively saved by converting the current signals into voltage signals for comparison.

Further, the pixel circuit of the present disclosure may further include a tenth transistor, a gate of the tenth transistor is configured to be input with a reset control signal, a source of the tenth transistor is configured to be input with a reset voltage, and a drain of the tenth transistor is coupled with an anode of the light emitting device. Therefore, the light emitting device of the pixel circuit can be reset after a previous frame signal is displayed, which effectively reduces influence of the previous frame signal on a next frame signal.

Further, the pixel circuit of the present disclosure may further include a data current module, and the data current module may include an operational amplifier, a fifth transistor and a first resistor. A first input terminal of the operational amplifier may be connected with the data voltage terminal, a drain of the fifth transistor may be connected with a second input terminal of the operational amplifier. A gate of the fifth transistor may be connected with an output terminal of the operational amplifier, a source of the fifth transistor may be connected with a power supply, and a drain of the fifth transistor may be configured to output the data current. A first terminal of the first resistor may be connected to the drain of the fifth transistor, and a second terminal of the first resistor may be grounded. Thus, the output data current will become more stable by receiving the data voltage via the operational amplifier and by reducing the effect of the data voltage jitter via a negative feedback loop of the operational amplifier.

DETAILED DESCRIPTION

In order to make the above-mentioned objects, features and advantages of the present disclosure more easily understood, specific embodiments of the present disclosure will be described in detail with reference to the accompanying drawings below. Apparently, embodiments described below are merely a portion of embodiments of the present disclosure, and are not all embodiments. All other embodiments obtained by those of ordinary skill in the art without making creative work are within the scope of the present disclosure, based on embodiments disclosed hereinafter.

Figure 1:
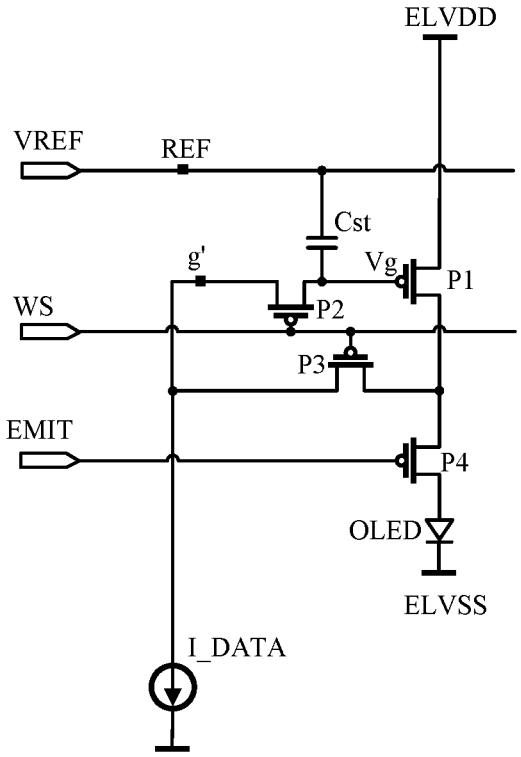
Fig. 1 (prior art)
FIG. 1 schematically illustrates a structural diagram of a pixel circuit in a conventional technology.
Figure 2:
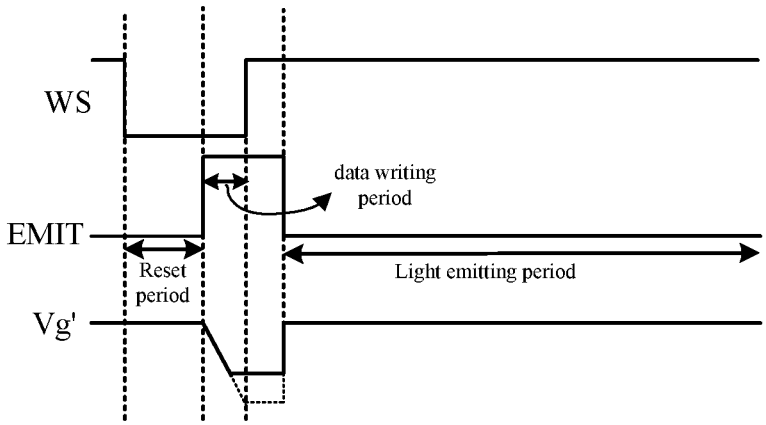
Fig. 2 (prior art)
FIG. 2 schematically illustrates an operation time sequence diagram of a pixel circuit in a conventional technology.

FIG. 1 schematically illustrates a structural diagram of a pixel circuit in a conventional technology. FIG. 2 schematically illustrates an operation time sequence diagram of a pixel circuit in a conventional technology.

Referring to FIGS. 1 and 2, the pixel circuit in the conventional technology may include a first transistor P1, a second transistor P2, a third transistor P3, a fourth transistor P4, a capacitor Cst and a light emitting device OLED. A source of the first transistor P1 is connected with a power supply ELVDD, a drain of the first transistor P1 is connected with a drain of the fourth transistor P4, a source of the fourth transistor P4 is connected with an anode of the light emitting device OLED, a cathode of the light emitting device OLED is grounded to ELVSS, a first electrode plate of the capacitor Cst is connected with a gate of the first transistor P1, and a second electrode plate of the capacitor Cst is connected with a reference voltage terminal REF.

In a reset period, the anode of the light emitting device OLED receives a reset voltage (not shown) to complete reset of the light emitting device OLED, so as to eliminate the influence of a previous frame signal on a next frame signal.

In a data writing period, a gating control signal WS is set as a low level, and a light emission control signal EMIT is set as a high level. A gate voltage terminal g' is input with a data current I_DATA, and a gate of the first transistor P1 is coupled with a gate voltage terminal g' through the second transistor P2. Then, due to the second transistor P2 and the third transistor P3 being turned on, the fourth transistor P4 being turned off, a gate voltage Vg of the first transistor P1 is equal to a gate voltage Vg' of the gate voltage terminal g', and a drain voltage of the first transistor P1 is equal to a gate voltage Vg of the first transistor P1, the connection manner of the first transistor P1 is equivalent to the connection mode of a diode. If the time is sufficient, the data current I_DATA will pull down the gate voltage Vg' of the gate voltage terminal g' to a voltage corresponding to the data current I_DATA. That is, the gate voltage Vg of the first transistor P1 will be pulled down to a voltage corresponding to the data current I_DATA.

Subsequently, the gating control signal WS is set as a high level, the second transistor P2 is turned off, and the gate voltage Vg of the first transistor P1 is held by the capacitor Cst.

In a light emitting period, the gating control signal WS is set as a high level, and the light emission control signal EMIT is set as a low level, then the second transistor P2 and the third transistor P3 are turned off, the fourth transistor P4 is turned on, an operating current corresponding to the gate voltage Vg of the first transistor P1 which is held by the capacitor Cst flows to the light emitting device OLED, and the light emitting device OLED emits light.

In the data writing period, since a row of pixels usually have only a microsecond scan time, that is, each time the data is written, the turn-on time of the second transistor P2 and the third transistor P3 lasts only a few microseconds. During the few microseconds of operation time, the data current I_DATA may neither fully pull down the gate voltage Vg' of the gate voltage terminal g' to the voltage corresponding to the data current I_DATA, nor pull down the gate voltage Vg of the first transistor P1 to the voltage corresponding to the data current I_DATA, resulting in that a brightness of the light emitting device OLED may not be a brightness corresponding to the data current I_DATA in a subsequent light emitting period.

In the present disclosure, the pixel circuit may include a driving control circuit, and the driving control circuit may include: a data current module configured to provide a data current and to input the data current to the gate voltage terminal; and a current adjusting module, configured to control whether to input a compensation current to the gate voltage terminal according to a current value of the operating current. Thus, the voltage of the gate voltage terminal can be quickly established via an interaction between the data current and the compensation current.

Figure 3:
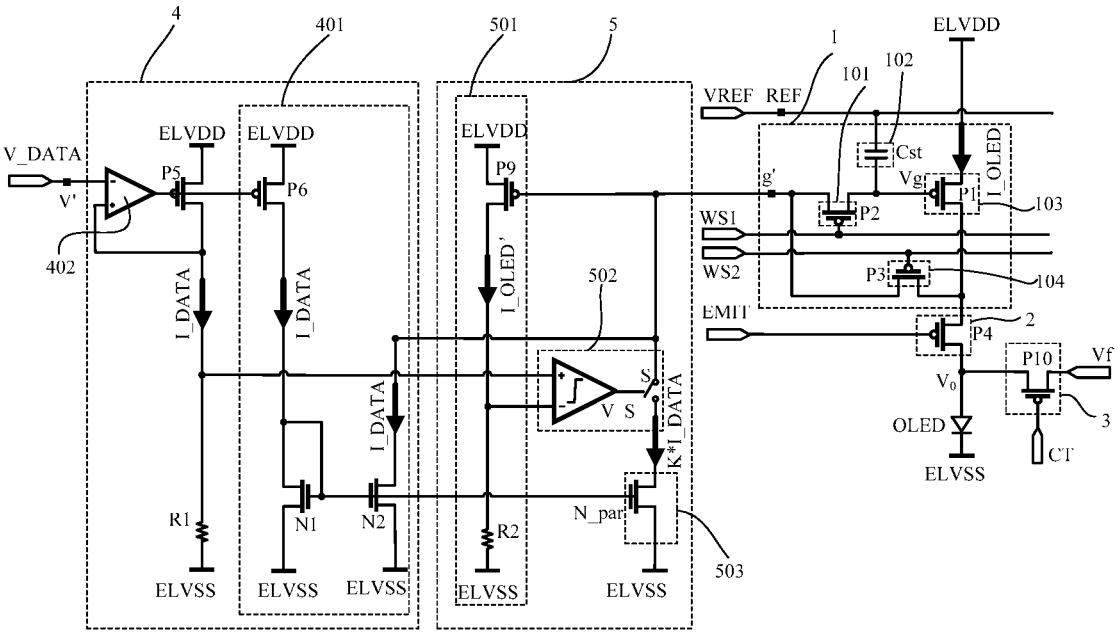
FIG. 3 schematically illustrates a structural diagram of a pixel circuit according to an embodiment of the present disclosure.

FIG. 3 schematically illustrates a structural view of a pixel circuit according to an embodiment of the present disclosure.

Referring to FIG. 3, the pixel circuit may include a pixel unit and a driving control circuit. The pixel unit may include an operating current generating module 1 and a light emission control module 2. The operating current generating module 1 has a gate voltage terminal g' and is configured to generate an operating current I_OLED according to a voltage of the gate voltage terminal g'. The light emission control module 2 is connected in series with the operating current generating module 1, and is configured to control whether to provide the operating current I_OLED to a light emitting device OLED according to a light emission control signal EMIT. The driving control circuit may include: a data current module 4 and a current adjusting module 5, where the data current module 4 is configured to provide a data current I_DATA and to input the data current I_DATA to the gate voltage terminal g', and the current adjusting module 5 is configured to control whether to input a compensation current to the gate voltage terminal g' according to a current value of the operating current I_OLED.

In the present embodiment, the gate voltage terminal g' may serve as a connection port through which the pixel unit performs signal interaction with other components in the pixel circuit.

In some embodiments, a current direction of the compensation current may be the same as or opposite to a current direction of the data current I_DATA.

In some embodiments, when the data current I_DATA is small, the compensation current may have a same direction as the data current I_DATA, in this condition, if the operating current I_OLED is detected to be small, the compensation current and the data current I_DATA may be provided to the gate voltage terminal g' together, and if the operating current I_OLED is detected to be sufficiently large, only the data current I_DATA may be provided and the compensation current may be turned off. When the data current I_DATA is large, the compensation current may be opposite to the direction of the data current I_DATA, in this condition, if the operating current I_OLED is detected to be small, only the data current I_DATA is provided and the compensation current is turned off, and if the operating current I_OLED is detected to be large, the compensation current and the data current I_DATA can be provided to the gate voltage terminal g' together. Therefore, the current input to the gate voltage terminal g' is large before the operating current I_OLED is sufficiently large; while the current input to the gate voltage terminal g' becomes small when the operating current I_OLED is sufficiently large.

In some embodiments, the data current module 4 may directly input the data current I_DATA to the gate voltage terminal g', or may firstly mirror the data current I_DATA, and then input the mirrored current to the gate voltage terminal g'.

In some embodiment, the light emission control signal EMIT may be a level signal. For example, when the light emitting control signal EMIT is a low level signal, the light emission control module 2 may be controlled to start working; and when the light emission control signal EMIT is a high level signal, the light emission control module 2 may be controlled to not work.

In some embodiment, the light emitting device OLED may be a light emitting diode. An anode of the light emitting diode may be connected with a light emission control module, and a cathode of the light emitting diode may be grounded to ELVSS.

More specifically, the light emitting diode may be an Organic Light Emitting Diode.

It should be noted that, the pixel circuit according to embodiments of the present disclosure may be used to supply power to various light-emitting devices, and types of the light-emitting devices are not limited hereto.

In some embodiments, the operating current generating module 1 may include a driving module 103, a second gating module 104 and a voltage holding module 102. A control terminal of the driving module 103 is connected with the gate voltage terminal g' via a first gating module 101, the driving module 103 is configured to generate the operating current I_OLED according to a voltage of its control terminal, and the first gating module 101 is turned on or turned off under control of a first gating control signal WS1. An output terminal of the driving module 103 may be connected with the gate voltage terminal g' via the second gating module 104, and the second gating module 104 may be turned on or turned off under control of the second gating control signal WS2. The voltage holding module 102 may be configured to maintain a voltage of the control terminal of the driving module 103 when the first gating module 101 is turned off.

In some embodiments, the driving module 103 may include a first transistor P1, a source of the first transistor P1 may be connected with a power supply ELVDD, a gate of the first transistor P1 may serve as the control terminal of the driving module 103, and a drain of the first transistor P1 may serve as the output terminal of the driving module 103.

In some embodiments, the first gating module 101 may include a second transistor P2, a gate of the second transistor P2 is input with the first gating control signal WS1, a source of the second transistor P2 is connected with the control terminal of the driving module 103, and a drain of the second transistor P2 may be connected with the gate voltage terminal g'. The second gating module 104 may include a third transistor P3, a gate of the third transistor P3 is input with the second gating control signal WS2, a drain of the third transistor P3 is connected with the gate voltage terminal g', and a source of the third transistor P3 is connected with the output terminal of the driving module 103.

In some embodiments, the first gating control signal WS1 and the second gating control signal WS2 may be level signals. For example, when the first gating control signal WS1 and/or the second gating control signal WS2 are low level signals, the second transistor P2 and/or the third transistor P3 may be controlled to be turned on; and when the first gate control signal WS1 and/or the second gate control signal WS2 are high level signals, the second transistor P2 and/or the third transistor P3 may be controlled to be turned off.

In some embodiments, the voltage holding module 102 may include a capacitor Cst, a first electrode plate of the capacitor Cst may be connected with the control terminal of the driving module 103, and a second electrode plate of the capacitor Cst may be connected with a reference voltage terminal REF. After the voltage of the control terminal of the driving module 103 is established, the capacitor Cst may maintain the voltage of the control terminal of the driving module 103.

In some embodiments, the reference voltage VREF received by the reference voltage terminal REF may be a direct current (DC) voltage or an alternating current (AC) voltage.

In some embodiments, the reference voltage VREF may be a voltage of a fixed value, or a voltage with an adjustable value, so as to meet the lighting requirements of the light emitting devices OLEDs of different models and different volumes. Those skilled in the art may adaptively set the value of the reference voltage VREF according to specific needs and application scenarios, which will not be limited to embodiments of the present disclosure.

In some embodiments, the light emission control module 2 may include a fourth transistor P4, a gate of the fourth transistor P4 is input with the light emission control signal EMIT, a drain of the fourth transistor P4 is connected with an output terminal of the operating current generating module 1, and a source of the fourth transistor P4 is connected with the light emitting device OLED.

In some embodiments, the output terminal of the operating current generating module 1 may be a port for outputting the operating current I_OLED. The operating current I_OLED may flow into the light emitting device OLED via the fourth transistor P4 after flowing out of the output terminal of the operating current generating module 1.

In some embodiments, the light emission control signal EMIT may be a level signal. For example, when the light emission control signal EMIT is a low level signal, the fourth transistor P4 may be controlled to be turned on; and when the light emission control signal EMIT is a high level signal, the fourth transistor P4 may be controlled to be turned off.

In a non-limiting embodiment, the data current module 4 may receive the data current I_DATA from an external and input the data current I_DATA to the gate voltage terminal g'. The data current module 4 may filter the data current I_DATA supplied by the external directly to reduce current ripple in the data current I_DATA.

In another non-limiting embodiment, the data current module 4 may be connected with a data voltage terminal V' and may be configured to generate the data current I_DATA based on a data voltage V_DATA of the data voltage terminal V'. Hereinafter, details will be described by taking the data current module 4 generating the data current I_DATA based on the data voltage V_DATA of the data voltage terminal V' as an example.

In some embodiments, the data voltage V_DATA of the data voltage terminal V' may be a voltage of a fixed value or a voltage with an adjustable value, so as to meet the lighting requirements of the light emitting devices OLEDs of different models and different volumes. Those skilled in the art may adaptively set the value of the data voltage V_DATA according to specific needs and application scenarios, which will not be limited to embodiments of the present disclosure.

In some embodiments, the data current module 4 may include an operational amplifier 402, a fifth transistor P5 and a first resistor R1. A first input terminal of the operational amplifier 402 is connected with the data voltage terminal V'. A drain of the fifth transistor P5 is connected with a second input terminal of the operational amplifier 402, a gate of the fifth transistor P5 is connected with an output terminal of the operational amplifier 402, a source of the fifth transistor P5 is connected with a power supply ELVDD, and the drain of the fifth transistor P5 outputs the data current I_DATA. A first terminal of the first resistor R1 is connected with the drain of the fifth transistor P5, and a second terminal of the first resistor R1 is grounded to ELVSS.

In some embodiments, the first input terminal of the operational amplifier 402 may be a negative input terminal, and the second input terminal of the operational amplifier 402 may be a positive input terminal. The first resistor R1 may be a fixed resistor or a variable resistor, and a resistance of the first resistor R1 may be set according to a specific application scenario.

In some embodiments, the data current module 4 may further include a current duplicating module 401, which is configured to mirror the data current I_DATA and is coupled with the gate voltage terminal g'.

In the present embodiment, mirroring the data current I_DATA may be an equal mirror of the data current value, or may be a multiple mirror of the data current value. The value of the current obtained by the equal mirror may be equal to the data current value, and the value of the current obtained by the multiple mirror may be in an arbitrary ratio with the data current value.

In some embodiments, the current duplicating module 401 may include a sixth transistor P6, a seventh transistor N1 and an eighth transistor N2. A gate of the sixth transistor P6 is connected with the output terminal of the operational amplifier 402, and a source of the sixth transistor P6 is connected with the power supply ELVDD. A drain of the seventh transistor N1 is connected with a drain of the sixth transistor P6, the drain of the seventh transistor N1 is connected with a gate of the seventh transistor N1, and a source of the seventh transistor N1 is grounded to ELVSS. A gate of the eighth transistor N2 is connected with a gate of the seventh transistor N1, a source of the eighth transistor N2 is grounded to ELVSS, and a drain of the eighth transistor N2 is connected with the gate voltage terminal g'.

In some embodiments, the current adjusting module 5 may include: a first current mirroring module 501, a compensation current generating module 503 and a comparing module 502. The first current mirroring module 501 is configured to mirror the operating current I_OLED of the operating current generating module 1 to generate a mirror current I_OLED'. The compensation current generating module 503 is configured to generate a compensating current. The comparing module 502 is configured to compare the data current I_DATA with the mirror current I_OLED', and to determine whether to input the compensation current to the gate voltage terminal g' according to a comparison result.

In some embodiments, the first current mirroring module 501 may include a ninth transistor P9 and a second resistor R2. A gate of the ninth transistor P9 is connected with the gate voltage terminal g', and a source of the ninth transistor P9 is connected with a power supply ELVDD. A first terminal of the second resistor R2 is connected with a drain of the ninth transistor P9, and a second terminal of the second resistor R2 is grounded to ELVSS.

In the present embodiment, the second resistor R2 may be a fixed resistor or a variable resistor, and its resistance value may be set according to a specific application scenario.

In some embodiments, the compensation current generating module 503 may include a second current mirroring module, which is configured to mirror the data current I_DATA to generate the compensation current.

In the present embodiment, the second current mirroring module may include a plurality of transistors N_par connected in parallel, and the plurality of transistors N_par connected in parallel may realize a multiple mirror of the data current value.

In some embodiments, the comparing module 502 may include a comparator. A first input terminal of the comparator is input with a first voltage, a second input terminal of the comparator is input with a second voltage, and an output terminal of the comparator outputs switch control signal V_S. The first voltage is obtained by converting the mirror current I_OLED', the second voltage is obtained by converting the data current I_DATA. An input terminal of the gating switch S is input with the compensation current, an output terminal of the gating switch S is connected with the gate voltage terminal g', and a control terminal of the gating switch S is input with the switch control signal V_S.

In some embodiments, the comparator may be a hysteresis comparator.

In some embodiments, the pixel circuit may further include a reset module 3. The reset module 3 may include a tenth transistor P10, a gate of the tenth transistor P10 is input with a reset control signal CT, a source of the tenth transistor P10 is input with a reset voltage Vf, and a drain of the tenth transistor P10 is connected to an anode of the OLED devices.

In some embodiment, the reset control signal CT may be a level signal. For example, when the reset control signal CT is a low level signal, the tenth transistor P10 may be controlled to be turned on; and when the reset control signal CT is a high level signal, the tenth transistor P10 may be controlled to be turned off.

In some embodiment, the reset voltage Vf may be smaller than a turn-on voltage of the light emitting device OLED, thereby ensuring that the OLED device will not be accidentally turned on during the reset period.

Figure 4:
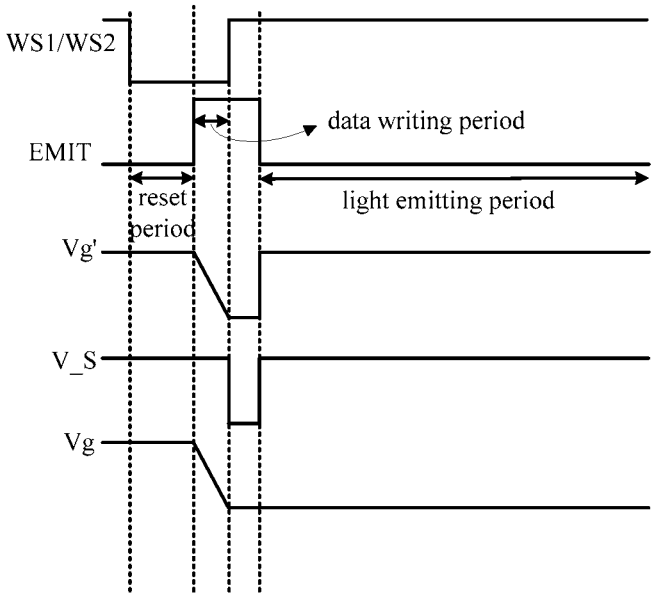
FIG. 4 schematically illustrates an operation time sequence diagram of a pixel circuit according to an embodiment of the present disclosure.

In a non-limiting embodiment, operating periods of the pixel circuit may mainly include three periods. An operation process of the pixel circuit will be described in detail below with reference to FIGS. 3 and 4. FIG. 4 schematically illustrates an operation timing sequence diagram of a pixel circuit according to an embodiment of the present disclosure.

In the reset period, the first gating control signal WS1 is set as a low level signal, the second gating control signal WS2 is set as a low level signal, the light emission control signal EMIT is set as a low level signal, and the reset control signal CT is set as a low level signal.

In the reset period, the second transistor P2, the third transistor P3, the fourth transistor P4 and the tenth transistor P10 are turned on. Since the second transistor P2 and the third transistor P3 are turned on, the gate of the first transistor P1 and the drain of the first transistor P1 are both connected with the gate voltage terminal g', then the first transistor P1 is equivalent to a diode in the circuit. Since the tenth transistor P10 is turned on, the anode of the light emitting device OLED is input with the reset voltage Vf, that is, the anode voltage V0 of the light emitting device OLED is equal to the reset voltage Vf. The reset voltage Vf may be set to be smaller than the turn-on voltage of the light emitting device OLED, then the light emitting device OLED will not emit light during the reset period.

The reset operation can eliminate the influence of a display state of a previous frame of pixels on a display state of a next frame of pixels.

In the data writing period, the first gating control signal WS1 is set as a low level signal, the second gating control signal WS2 is set as a low level signal, the light emission control signal EMIT is set as a high level signal, and the reset control signal CT is set as a high level signal.

In the data writing period, the second transistor P2 and the third transistor P3 are turned on, and the fourth transistor P4 and the tenth transistor P10 are turned off. Since the gates of the first transistor P1 and the ninth transistor P9 are both connected with the gate voltage terminal g', and the sources of the first transistor P1 and the ninth transistor P9 are both connected with the power supply ELVDD, the ninth transistor P9 can mirror the operating current I_OLED generated by the first transistor P1 to obtain the mirror current I_OLED', and the mirror current I_OLED' flows through the second resistor R2.

The data voltage V_DATA of the data voltage terminal V' is converted into a data current I_DATA via the operational amplifier 402 and the fifth transistor P5, and the data current I_DATA flows through the first resistor R1.

In the present embodiment, a resistance of the first resistor R1 may be set to be equal to a resistance of the second resistor R2.

Since a positive input terminal of the comparator is connected with the first terminal of the first resistor R1, and the positive input terminal of the comparator is input with the first voltage, the voltage value of the first voltage is I_DATA×R1. Since a negative input terminal of the comparator is connected with the first terminal of the second resistor R2, and the negative input terminal of the comparator is input with the second voltage, the voltage value of the second voltage is I_OLED'×R2. When the pixel circuit just entered the data writing period, the data current I_DATA may be larger than the mirror current I_OLED'. In the condition that the resistance of the first resistor R1 is equal to the resistance of the second resistor R2, the first voltage is greater than the second voltage, and the comparator outputs a high level. The high level as the switch control signal V_S of the gating switch S controls the gating switch S to be turned on so as to input the compensation current to the gate voltage terminal g'. The compensation current is obtained by mirroring the data current I_DATA via the second current mirror module. In a non-limiting embodiment, the second current mirroring module may include k transistors N_par connected in parallel, and the current value of the compensation current may be I_DATA×k.

Since the data current I_DATA equally mirrored by the current duplicating module 401 is input to the gate voltage terminal g, the pull-down current input to the gate voltage terminal g' is a superposition of the compensation current and the data current, i.e. I_DATA×(k+1). The superposed current can quickly discharge at the gate voltage terminal g'.

As the gate voltage terminal g' continuously discharging, the operating current I_OLED generated by the first transistor P1 increases, and the mirror current I_OLED' increases following the increase of the operating current I_OLED, and the second voltage increases accordingly. When the second voltage is equal to the first voltage, a level jump occurs at the output terminal of the comparator, and a low level signal is output. The low level signal as the switch control signal V_S of the gating switch S controls the gating switch S to be turned off, so as to prevent the compensation current from flowing into the gate voltage terminal g'. Then, the operating current I_OLED generated by the first transistor P1 corresponds to the data current I_DATA generated by the data current module 4. That is, control of brightness of the light emitting device OLED by the data current I_DATA is converted into control of brightness of the light emitting device OLED by the operating current I_OLED generated by the first transistor P1.

In the light emitting period, the first gating control signal WS1 is set as a high level, the second gating control signal WS2 is set as a high level, the light emission control signal EMIT is set as a low level, and the reset control signal CT is set as a high level.

In the light emitting period, the second transistor P2, the third transistor P3 and the tenth transistor P10 are turned off, and the fourth transistor P4 is turned on. Since the second transistor P2 is turned off, the gate voltage Vg of the first transistor P1 is held by the capacitor Cst. Since the fourth transistor P4 is turned on, the operating current I_OLED corresponding to the gate voltage Vg of the first transistor P1 flows to the light emitting device OLED through the fourth transistor P4, and drives the light emitting device OLED to emit light. Since the operating current I_OLED corresponds to the data current I_DATA, the luminance of the light emitting device is actually determined by the data current I_DATA.

Figure 5:
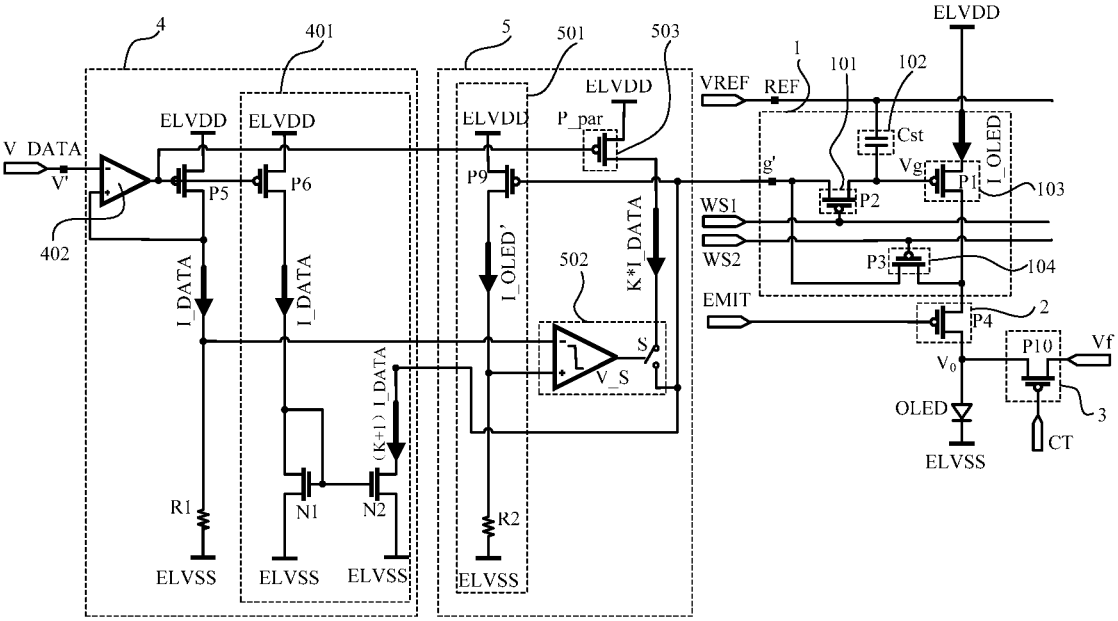
FIG. 5 schematically illustrates a structural diagram of a pixel circuit according to another embodiment of the present disclosure.

FIG. 5 schematically illustrates a structural diagram of a pixel circuit according to another embodiment of the present disclosure.

Referring to FIG. 5, in another non-limiting embodiment, the pixel circuit may include a pixel unit and a driving control circuit. Regarding the structure and working principle of the pixel unit, reference may be made to the description of the pixel circuits in FIGS. 3 and 4, and regarding the reset period and the light emitting period of the pixel circuit, reference may be made to the related descriptions in FIGS. 3 and 4 as well, which will not be described in detail herein. Hereinafter, the discharging process of a voltage Vg' of a gate voltage terminal g' in the data writing period will be described in detail below.

A compensation current generating module 503 for providing compensation current in FIG. 5 may include a second current mirroring module. The second current mirroring module may include k transistors P_par connected in parallel, gates of the k transistors P_par connected in parallel are connected with an output terminal of the operational amplifier 402, sources of the k transistors P_par connected in parallel are connected with the power supply ELVDD, drains of the k transistors P_par connected in parallel are connected with an input terminal of a gating switch S, an output terminal of the gating switch S is connected with the gate voltage terminal g', and a control terminal of the gating switch S is input with a switch control signal V_S. Then, the compensation current is a pull-up current, and its current value is I_DATA×k.

In the data writing period, a first gating control signal WS1 is set as a low level, a second gating control signal WS2 is set as a low level, a light emission control signal EMIT is set as a high level, and a reset control signal CT is set as a high level.

In the data writing phase, a second transistor P2 and a third transistor P3 are turned on, and a fourth transistor P4 and a tenth transistor P10 are turned off. Since gates of a first transistor P1 and a ninth transistor P9 are both connected with the gate voltage terminal g', and sources of the first transistor P1 and the ninth transistor P9 are both connected with a power supply ELVSS, then the ninth transistor P9 may mirror an operating current I_OLED generated by the first transistor P1 to generate a mirror current I_OLED', and the mirror current I_OLED' flows through a second resistor R2.

A data voltage V_DATA of a data voltage terminal V' is converted to a data current I_DATA via an operational amplifier 402 and a fifth transistor P5, and the data current I_DATA flows through a first resistor R1.

In the present embodiment, a resistance of the first resistor R1 may be set to be equal to a resistance of the second resistor R2.

Since a negative input terminal of the comparator is connected with the first terminal of the first resistor R1, the negative input terminal of the comparator is input with the first voltage, and a voltage value of the first voltage is I_DATA×R1. Since a positive input terminal of the comparator is connected with the first terminal of the second resistor R2, the positive input terminal of the comparator is input with the second voltage, and a voltage value of the second voltage is I_OLED'×R2. When the pixel circuit just entered the data writing period, the data current I_DATA may be larger than the mirror current I_OLED'. In the condition that the resistance of the first resistor R1 is equal to the resistance of the second resistor R2, the first voltage is greater than the second voltage, and the comparator outputs a low level. The low level as the switch control signal V_S of the gating switch S controls the gating switch S to be turned off so as to prevent the compensation current from flowing into the gate voltage terminal g'. Then, the gate voltage terminal g' is input with only the current obtained by multiple times of mirroring the data current I_DATA via the current duplicating module 401. For example, if the multiple times are (k+1), the pull-down current input to the gate voltage terminal g' is I_DATA×(k+1), so that the gate voltage terminal g' can be quickly discharged.

As the gate voltage terminal g' continuously discharging, the operating current I_OLED generated by the first transistor P1 increases, the mirror current I_OLED' increases following the increase of the operating current I_OLED, and the second voltage increases accordingly. When the second voltage is equal to the first voltage, a level jump occurs at the output terminal of the comparator, and a high level is output. The high level as the switch control signal V_S of the gating switch S controls the gate switch S to be turned on, and the compensation current I_DATA×k serves as a pull-up current and can partially offset the pull-down current I_DATA×(k+1).

Then, the operating current I_OLED generated by the first transistor P1 corresponds to the data current I_DATA generated by the data current module 4. That is, control of brightness of the light emitting device OLED by the data current I_DATA is converted into control of brightness of the light emitting device OLED by the operating current I_OLED generated by the first transistor P1.

In some embodiments, a display device including the aforementioned pixel circuit is provided according to an embodiment of the present disclosure. The pixel circuit may be any of the pixel circuits shown in FIGS. 3 and 5, or any of the pixel circuits mentioned in the related description of FIGS. 3 and 5.

In some embodiments, the display device may be a liquid crystal display (LCD), a plasma display panel (PDP), a field emission display (FED), an electroluminescence display (ELD), an electrochromic display (ECD), a laser display, and so on.

With regard to the process of display and brightness compensation of the display device using the foregoing pixel circuit, reference may be made to the related description of the pixel circuits according to the embodiments shown in FIGS. 3-5, which will not be described in detail herein.

It should be noted that, there is no specific limitation on the voltage values of the "high level" and the "low level" in the present disclosure, as long as the voltage value of the high level is higher than the voltage value of the low level. For example, the voltage value of the high level may be identified as logic "1", and the voltage value of the low level may be identified as logic "0".

Although the present disclosure is described above, the present disclosure is not limited thereto. Any changes and modifications may be made by those skilled in the art without departing from the spirit and scope of the invention, and the scope of the invention should be determined by the scope defined by the claims.

The invention claimed is:

1. A pixel circuit, comprising:

a pixel unit, comprising an operating current generating circuitry and a light emission control circuitry, wherein the operating current generating circuitry has a gate voltage terminal and is configured to generate an operating current according to a voltage of the gate voltage terminal, and the light emission control circuitry is connected in series with the operating current generating circuitry, and is configured to control whether to provide the operating current to a light emitting device according to a light emission control signal;

a driving control circuit, comprising a data current circuitry and a current adjusting circuitry, wherein the data current circuitry is configured to provide a data current and to input the data current to the gate voltage terminal, and the current adjusting circuitry is configured to control whether to input a compensation current to the gate voltage terminal according to a current value of the operating current; and a first transistor, wherein a gate of the first transistor is configured to be input with a reset control signal, a source of the first transistor is configured to be input with a reset voltage, and a drain of the first transistor is coupled with an anode of the light emitting device.

2. The pixel circuit according to claim 1, wherein the operating current generating circuitry comprises: a driving circuitry, a second gating circuitry and a voltage holding circuitry;

a control terminal of the driving circuitry is connected with the gate voltage terminal via a first gating circuitry, the driving circuitry is configured to generate the operating current according to a voltage of the control terminal, and the first gating circuitry is turned on or turned off under control of a first gating control signal;

an output terminal of the driving circuitry is connected with the gate voltage terminal via the second gating circuitry, and the second gating circuitry is turned on or turned off under control of a second gating control signal; and the voltage holding circuitry is configured to maintain a voltage of the control terminal of the driving circuitry when the first gating circuitry is turned off.

3. The pixel circuit according to claim 2, wherein the driving circuitry comprises a second transistor, a source of the second transistor is connected with a power supply, a gate of the second transistor serves as the control terminal of the driving circuitry, and a drain of the second transistor is the output terminal of the driving circuitry.

4. The pixel circuit according to claim 2, wherein the first gating circuitry comprises a second transistor, a gate of the second transistor is configured to be input with the first gating control signal, a source of the second transistor is connected with the control terminal of the driving circuitry, and a drain of the second transistor is connected with the gate voltage terminal.

5. The pixel circuit according to claim 2, wherein the second gating circuitry comprises a second transistor, a gate of the second transistor is configured to be input with the second gating control signal, a drain of the second transistor is connected with the gate voltage terminal, and a source of the second transistor is connected with the output terminal of the driving circuitry.

6. The pixel circuit according to claim 2, wherein the voltage holding circuitry comprises a capacitor, a first electrode plate of the capacitor is connected with the control terminal of the driving circuitry, and a second electrode plate of the capacitor is connected with a reference voltage terminal.

7. The pixel circuit according to claim 1, wherein the light emission control circuitry comprises a second transistor, a gate of the second transistor is configured to be input with the light emission control signal, a drain of the second transistor is connected with an output terminal of the operating current generating circuitry, and a source of the second transistor is connected with the light emitting device.

8. The pixel circuit according to claim 1, wherein the data current circuitry is connected with a data voltage terminal; and the data current circuitry is configured to generate the data current according to a data voltage of the data voltage terminal, or the data current circuitry is configured to receive the data current from an external and to input the data current to the gate voltage terminal.

9. The pixel circuit according to claim 8, wherein the data current circuitry comprises:

an operational amplifier, a first input terminal of the operational amplifier being connected with the data voltage terminal;

a second transistor, a drain of the second transistor being connected with a second input terminal of the operational amplifier, a gate of the second transistor being connected with an output terminal of the operational amplifier, a source of the second transistor being connected with a power supply, and the drain of the second transistor being configured to output the data current; and a first resistor, a first terminal of the first resistor being connected with the drain of the second transistor, and a second terminal of the first resistor being grounded.

10. The pixel circuit according to claim 9, wherein the data current circuitry further comprises: a current duplicating circuitry, configured to mirror the data current and coupled with the gate voltage terminal.

11. The pixel circuit according to claim 10, wherein the current duplicating circuitry comprises:

a third transistor, a gate of the third transistor being connected with the output terminal of the operational amplifier, and a source of the third transistor being connected with a power supply;

a fourth transistor, a drain of the fourth transistor being connected with a drain of the third transistor, the drain of the fourth transistor being connected with the gate of the fourth transistor, and a source of the fourth transistor being grounded; and an fifth transistor, a gate of the fifth transistor being connected with a gate of the fourth transistor, a source of the fifth transistor being grounded, and a drain of the fifth transistor being connected with the gate voltage terminal.

12. The pixel circuit according to claim 1, wherein the current adjusting circuitry comprises:

a first current mirroring circuitry, configured to mirror the operating current of the operating current generating circuitry to obtain a mirror current;

a compensation current generating circuitry, configured to generate the compensation current; and a comparing circuitry, configured to compare the data current and the mirror current, and to determine whether to input the compensation current to the gate voltage terminal according to a comparison result.

13. The pixel circuit according to claim 12, wherein the first current mirroring circuitry comprises:

a second transistor, a gate of the second transistor being connected with the gate voltage terminal, and a source of the second transistor being connected with a power supply; and a second resistor, a first terminal of the second resistor being connected with a drain of the second transistor, and a second terminal of the second resistor being grounded.

14. The pixel circuit according to claim 12, wherein the compensation current generating circuitry comprises a second current mirroring circuitry, configured to mirror the data current to obtain the compensation current.

15. The pixel circuit according to claim 12, wherein the comparing circuitry comprises:

a comparator, a first input terminal of the comparator being configured to be input with a first voltage, a second input terminal of the comparator being configured to be input with a second voltage, and an output terminal of the comparator being configured to output a switch control signal, wherein the first voltage is obtained by a conversion of the mirror current, and the second voltage is obtained by a conversion of the data current; and a gating switch, an input terminal of the gating switch being configured to be input with the compensation current, an output terminal of the gating switch being connected with the gate voltage terminal, and a control terminal of the gating switch being configured to be input with the switch control signal.

16. The pixel circuit according to claim 1, wherein a current direction of the compensation current is the same as or opposite to a current direction of the data current.

17. A display device, comprising: a pixel circuit;

wherein the pixel circuit comprises:

a pixel unit, comprising an operating current generating circuitry and a light emission control circuitry, wherein the operating current generating circuitry has a gate voltage terminal and is configured to generate an operating current according to a voltage of the gate voltage terminal, and the light emission control circuitry is connected in series with the operating current generating circuitry, and is configured to control whether to provide the operating current to a light emitting device according to a light emission control signal;

a driving control circuit, comprising a data current circuitry and a current adjusting circuitry, wherein the data current circuitry is configured to provide a data current and to input the data current to the gate voltage terminal, and the current adjusting circuitry is configured to control whether to input a compensation current to the gate voltage terminal according to a current value of the operating current; and a transistor, wherein a gate of the transistor is configured to be input with a reset control signal, a source of the transistor is configured to be input with a reset voltage, and a drain of the transistor is coupled with an anode of the light emitting device.

* * * * *